US005171506A

United States Patent [19]

Sakuda et al.

[11] Patent Number: 5,171,506

[45] Date of Patent: Dec. 15, 1992

[54] PROCESS FOR PRODUCING POLYESTER FIBERS

[75] Inventors: Mitsuhiro Sakuda; Kazuyuki Yabuki; Hideaki Ishihara; Yoshimitsu Sakaguchi; Tooru Kitagawa, all of Ootsu, Japan

[73] Assignee: Toyo Boseki Kabushiki Kaisha, Osaka, Japan

[21] Appl. No.: 683,542

[22] Filed: Apr. 10, 1991

[30] Foreign Application Priority Data

Apr. 19, 1990 [JP] Japan ..... 2-103715

[51] Int. Cl.[5] ..... D01F 6/84

[52] U.S. Cl. ..... 264/211.14; 264/176.1; 264/331.21

[58] Field of Search ..... 264/176.1, 211.14, 331.21

[56] References Cited

U.S. PATENT DOCUMENTS 4,071,502 1/1978 Sugiyama et al. ..... 264/210.2
4,118,372 10/1978 Schaefgen ..... 528/190
4,195,051 3/1980 Frankfort et al. ..... 264/176.1
4,663,423 5/1987 Yamada et al. ..... 528/180

FOREIGN PATENT DOCUMENTS 2814104 10/1979 Fed. Rep. of Germany ..... 264/211.14
3803663 8/1989 Fed. Rep. of Germany .
59-47423 3/1984 Japan .

*Primary Examiner*—Jan H. Silbaugh
*Assistant Examiner*—Catherine Timm
*Attorney, Agent, or Firm*—Wegner, Cantor, Mueller & Player

[57] ABSTRACT

Polyester fibers having high tenacity and high modulus can be produced practically and economically by melt-spinning a copolyester at a take-up speed of 3,000 meters/min. or more. The copolyester comprises at least 60 mol % of ethylene terephthalate units, has a persistence length of 15 angstroms or more and does not show a liquid crystalline nature in the molten state.

7 Claims, No Drawings

PROCESS FOR PRODUCING POLYESTER FIBERS

The present invention relates to a process for stably producing polyester fibers having high tenacity and high modulus.

High-tenacity and high-modulus fibers by lyotropic liquid crystal spinning arose from polyparaphenylene terephthalamide fibers and have been applied also to thermotropic liquid crystals, and various high-tenacity fibers of liquid crystalline polyarylates have been developed (Yabuki et al, *High-tenacity High-modulus Fibers*, published by Kyoritsu Publishing Co., Japan, 1988, Chap. 6).

However, it is difficult to say that the already developed fibers of liquid crystalline polyarylates have been put to practical use. The reason is that the raw materials of these kinds of fibers are expensive and an industrial method of inexpensively and stably producing them has not been established as yet, though it has already been found that the fibers are comparable to or superior to already commercialized Kevlar® fibers (product by DuPont) with respect to the mechanical properties.

The present invention has been made in consideration of the situation. Accordingly, the object of the present invention is to overcome the practical and economical problems in the conventional process of producing polyester fibers having high tenacity and high modulus, which could not be solved by the prior art techniques, and to provide a process for stably producing polyester fibers having high tenacity and high modulus.

As a means of overcoming the above-mentioned problems, therefore, there is provided in accordance with the present invention a process for producing polyester fibers, which is characterized by subjecting a copolyester to melt-spinning at a take-up speed of 3000 meters/min. or higher, said copolyester comprising 60 mol % or more of ethylene terephthalate units, having a persistence length of 15 angstroms or more and not showing a liquid crystalline nature in the molten state. The present inventors have found that the relationship between the persistence length, showing the rigidity of molecular chain, and the liquid crystalline nature in the polymers agrees well with Flory's theoretical (P. J. Flory, *Proc. Roy. Soc.*, A234, 73 (1956). Also an increase of the persistence length of the molecular chain is recognized in the polymer melt under a shear flow or elongational flow, provided that the polymer has a persistence length of a determined value or more, so that pseudo-liquid crystal spinning of the polymer is possible.

There is no limitation on the combination of monomers capable of realizing polyesters having a persistence length of 15 angstroms or more. However, the object of the present invention is to produce high-tenacity and high-modulus fibers a low manufacture cost. Polyesters which constitute the polyester fibers of the present invention are those comprising 60 mol % or more of ethylene terephthalate units, along with rigid chain components or components which have groups with no flexibility, for example, essentially aromatic rings (especially preferably those as substituted at para-position) and carbon-carbon double bond, in the main chain, as comonomer components. The polyesters do not show a liquid crystalline nature in the molten state and have a persistence length of 15 angstroms or more.

In the case of polyesters having a persistence length of less than 15 angstroms, the isotropic polymer melt is not converted to a pseudo-liquid crystal by phase transition. Even though such polyesters are formed into fibers, the resulting fibers could not have the required physical properties of high tenacity and high modulus.

On the other hand, if the persistence length is more than 20 angstroms, the polymer melt is anisotropic. As a result, such an anisotropic polymer melt is to be spun by a so-called liquid crystal spinning, being differentiated from the polymer melt of the present invention which is to be spun by pseudo-liquid crystal spinning.

The persistence length is obtained in the manner discussed below.

Using the bond length and bond angle, it is possible to construct a model of an intended polymer molecular chain by a well known method. On the basis of the thus constructed model, the length between the terminals of one of the repeating units (unit length) which form the polymer molecular chain is obtained. Where the main chain of the polymer molecule contains a part which imparts flexibility to the molecular chain, such as an ether bond or methylene bond, some different molecular shapes could be considered. In the present case, the unit length is obtained from the typical shape having the longest molecular chain. For instance, with respect to polyethylene terephthalate, the unit length of the polyethylene terephthalate unit of:

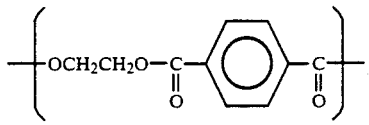

is determined to be 11 angstroms. Where dicarboxylic acids are used as the component (rigid chain component) having a group with no flexibility, such as a benzene ring or carbon-carbon double bond, in the main chain, one terminal of the dicarboxylic acid component is bonded with an ethylene glycol residue of a formula:

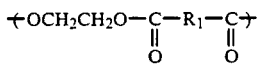

where $R_1$ represents

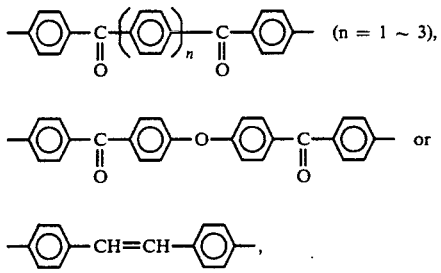

to give one repeating unit, and the unit length thereof is obtained. Where glycols are used as the rigid chain component, one repeating unit is composed of terephthalate residues which would be bonded to the both terminals and additionally one ethylene glycol residue as bonded to one terminal. That is, the repeating unit is represented by a formula:

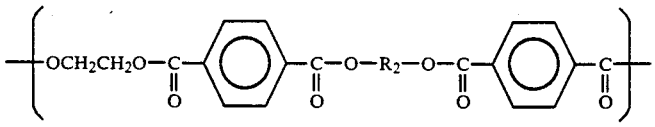

where R2 represents

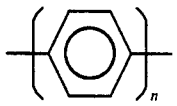

(n = 1 ~ 3),

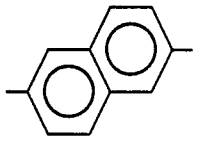

or

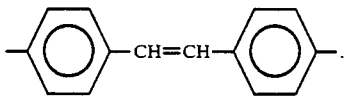

In the case, the unit length of the repeating unit is obtained.

Regarding copolyesters, the unit length corresponds to a mean unit length to be obtained from the following formula (1)

$$L = l_P \cdot (1 - X) + l_R \cdot X \quad (1)$$

where

L means a mean unit length of copolyester (angstrom); $l_P$ means a unit length of ethylene terephthalate (angstrom); $l_X$ means a unit length of rigid chain component (angstrom); and X means a copolymerization ratio of rigid chain component (by mol).

The present inventors have determined that the relationship between the mean unit length to be obtained as mentioned above and the persistence length satisfies the following formula (2):

$$q = L + 1 \quad (2)$$

where q means a persistence length (angstrom).

Specific examples of rigid chain components usable in the present invention as comonomers are mentioned below, which, however, are obviously not limitative because of the above-mentioned reasons.

Specifically, the rigid chain component may be selected from dicarboxylic acids having a unit length of 19 angstroms or more, such as bisbenzoylbiphenyl ether, bisbenzoylbiphenyl and bisbenzoylterphenyl; and glycols such as hydroquinone, methylhydroquinone, ethylhydroquinone, phenylhydroquinone, 4,4'-dihydroxybiphenyl and 4,4'-dihydroxyterphenyl. Additionally, hydroxycarboxylic acids such as phydroxybenzoic acid and 2,6'-hydroxynaphthoic acid may also be used as the component.

The copolyesters may be prepared in accordance with any conventional polycondensation method of producing conventional polyesters, for example, by melt-polymerizing acetylated monomers, and the preparing method itself is not specifically defined.

In order to satisfy the object of the present invention of inexpensively producing polyester fibers with high tenacity and high modulus, it is important that the main component of the polyester comprises ethylene terephthalate units. For this, it is preferred that 60 mol % or more of the components constituting the polyester comprises ethylene terephthalate units. If the content of ethylene terephthalate units in the constitutive components is less than 60 mol %, it is difficult to say that the process of the present invention is advantageous in view of the cost of the raw materials.

In accordance with the process of the present invention, the copolyester satisfying the above-mentioned condition is subjected to melt-spinning. Melt-spinning is also an important factor in the process of the present invention, like the main component of the polyester comprising ethylene terephthalate units, for the purpose of producing the intended polyester fibers at a low manufacturing cost.

The polyester is melted and extruded out through a spinneret or orifice. The filaments as extruded in the form of a melt are cooled and solidified with a quenching gas. The spinning speed must be such that is sufficient for effecting phase transition of the isotropic polymer melt to a pseudo-liquid crystal. Though varying in accordance with the persistence length, SSF (take-up speed/jet velocity at orifice) is generally desired to be 250 or more, preferably 400 or more. The larger SSF, the better, from the viewpoint of improving the orientation of molecular chain. However, if SSF is too large, there will be caused an unstable spinning phenomenon such as draw resonance phenomenon or the like, which will then often be a cause of yarn breakage. Under the situation, the uppermost critical value of SSF could not be defined generally but would be defined in consideration of the kind of the polymer to be spun, the spinning condition, the nozzle temperature and the take-up speed.

The take-up speed that is sufficient for effecting phase transition of the isotropic polymer melt to a pseudo-liquid crystal is generally 3000 meters/min. or higher, preferably 4000 meters/min. or higher.

If the take-up speed is lower than 3000 meters/min., the isotropic polymer melt could not be converted into a pseudo-liquid crystal by phase transition, even though the persistence length satisfies the necessary condition of being 15 angstroms or more, so that polyester fibers having favorable properties of high tenacity and high modulus could not be obtained.

The higher the take-up speed, the better, from the viewpoint of high producibility. However, for the purpose of maintaining stable operation, the take-up speed of the current technical level is preferably approximately 8000 meters/min., especially preferably approximately 10000 meters/min.

The taken-up fibers have no more need to be further drawn and generally have a tenacity of 6 g/d or more and an initial modulus of 300 g/d or more. They have a hot air shrinkage at 160° C. of 0.5% or less. Such physical properties are sufficient for directly using the fibers in practical use. However, in order to further improve the physical properties, the fibers as they are may optionally be subjected to solid phase polymerization by heat-treatment. The heat-treatment may be effected in a gas or liquid or in vacuum, at a temperature near the melting point of the fibers. As means of applying heat to the fibers, there are mentioned a method of using a medium such as a gaseous or liquid medium, a method of using radiation heat from a hot plate or an infrared heater, an internal heating method with high frequency waves, and a direct heating method with a hot roller or a heater. The heat-treatment may be effected under tension or under no tension in accordance with the object. Regarding the form of the fibers to be subjected to the heat-treatment, the fibers may be heat-treated in the form of a hank or cheese or by continuous treatment between rollers. The thus heat-treated fibers may have improved physical properties. Precisely, they have an elevated tenacity of 15 g/d or more and a modulus of 300 g/d or more.

Next, the present invention will be explained in more detail by way of the following examples.

EXAMPLE 1

Dimethyl terephthalate (DMT) and an excess amount of ethylene glycol (EG) were reacted in an nitrogen stream in the presence of zinc acetate catalyst, by gradually heating them from room temperature up to 230° C., to obtain bishydroxyethyl terephthalate (BHET). On the other hand, 4,4'-bis(4-methoxycarbonylbenzoyl)diphenyl ether (BME) and a large excess amount of EG were subjected to BME/EG interesterification in a nitrogen stream in the presence, of zinc acetate catalyst under reflux of EG. After washing with water, the reaction product was refluxed and washed with aqueous 10% hydrochloric acid solution.

Next, BHET and BME/EG interesterified product were melted in a molar ratio of 79/21 in the presence of antimony trioxide catalyst at 280° C. and subjected to polymerization for 3 hours under reduced pressure to obtain a copolyester (A) having the following structure.

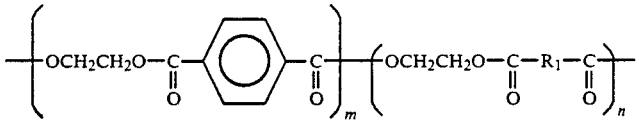

m:n = 79:21

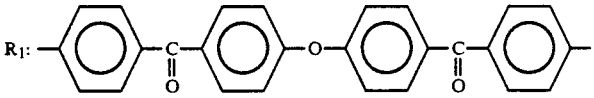

Using the above-mentioned formulae (1) and (2), the persistence length of the copolyester (A) was estimated to be about 15 angstroms. The copolyester (A) had a logarithmic viscosity , as measured in 0.5 g/dl of p-cresol/tetrachloroethane (3/1) solution at 30° C., of 1.7, and a polymer flow starting temperature, as measured with a melting point measuring device, of 245° C. Upon observation with a polarizing microscope, the polymer melt did not show optical anisotropic nature. The copolyester (A) was drawn out through a spinneret or orifice having a spinning hole diameter of 0.5 mm and a spinning hole number of 24 at a spinning temperature of 260° C. and at a spinning speed of 2.5 grams/min./hole and taken up at a take-up speed of 4500 meters/min. The spun filaments were cooled with an ordered quenching gas having a flow rate of 0.2 meter/min. and a temperature of 22° C.

Physical data of the thus obtained spun filaments are shown in Table 1 below. As is noted from the results, fibers having a practically sufficient tenacity and also having a high modulus and a low heat shrinkage were obtained only by spinning.

EXAMPLE 2 COMPARATIVE EXAMPLES 1 AND 2

The same process as in Example 1 was repeated to obtain various spun filaments, except that the take-up speed in spinning the copolyester (A) was varied as shown in Table 1 below. In the case, phase transition to pseudo-liquid crystal as intended by the present invention did not occur when the take-up speed was lower than 3000 meters/min., so that only fibers having unsatisfactory physical values were obtained. Physical values of the fibers obtained are shown in Table 1 below.

COMPARATIVE EXAMPLE 3

A copolyester (B) prepared by copolymerization of BHET and BME/EG in a molar ratio of 90/10 (the copolymer having an estimated persistence length of 13 angstroms) was spun by the same method as in Example 1 to obtain spun filaments. The physical data of the thus obtained fibers are shown in Table 2 below.

COMPARATIVE EXAMPLE 4

The same process as in Example 1 was repeated to obtain spun filaments, except that polyethylene naphthalate (PEN, having an estimated persistence length of 14 angstroms) was used as a polyester and the spinning speed and the spinning temperature were varied to 1.0 gram/min./hole and 310° C., respectively. Physical values of the thus obtained fibers are shown in Table 2 below.

In the case, the fibers had a poor initial modulus and a high hot air shrinkage, though having an improved tenacity because of high speed spinning. That is, spinning of the fibers was not pseudo-liquid crystal spinning as intended by the present invention.

EXAMPLES 3 AND 4

The spun filaments as obtained in Example 1 were reeled up in a metal reeling tool and heat-treated under reduced pressure of 0.1 mmHg and under the condition as indicated in Table 3 below. As a result of the heat-treatment, hightenacity and high-modulus fibers having a tenacity of more than 15 g/d and an initial modulus of more than 300 g/d were obtained. Physical values of the fibers obtained are shown in Table 3 below.

COMPARATIVE EXAMPLE 5

The spun filaments as obtained in Comparative Example 2 were heat-treated under the same conditions as those in Example 3. Physical values of the fibers obtained are shown in Table 3 below.

COMPARATIVE EXAMPLE 6

The spun filaments as obtained in Comparative Example 4 were heat-treated under the conditions as shown in Table 3. Physical values of the fibers obtained are shown in the same Table 3.

In the cases of Comparative Examples 5 and 6, pseudo-liquid crystal spinning as intended by the present invention was not effected in the spinning stage so that improvement of the tenacity of the fibers by heat-treatment was not attained.

TABLE 1

| | Example 1 | Example 2 | Comparative Example 1 | Comparative Example 2 |
|---|---|---|---|---|
| Spinning Conditions | | | | |
| Polymer | A | A | A | A |
| Persistence Length (Å) | 15 | 15 | 15 | 15 |
| Spinning Hole Diameter (mm) | 0.5 | 0.5 | 0.5 | 0.5 |
| Spinning Hole Number | 24 | 24 | 24 | 24 |
| Spinning Speed (g/min/hole) | 2.5 | 2.5 | 2.5 | 2.5 |
| Spinning Temperature (°C.) | 260 | 260 | 260 | 260 |
| Take-up Speed (m/min) | 4500 | 3500 | 1500 | 2500 |
| SSF | 424 | 330 | 141 | 236 |
| Physical Properties of Spun Filaments | | | | |
| Denier (d) | 121 | 156 | 364 | 221 |
| Tenacity (g/d) | 8.7 | 7.4 | 2.7 | 4.9 |
| Elongation at Break (%) | 4.2 | 5.6 | 120.8 | 26.9 |
| Initial Modulus (g/d) | 308 | 295 | 47 | 113 |
| 160° C. Hot Air Shrinkage (%) | 0.3 | 0.3 | 52.2 | 5.3 |

TABLE 2

| | Example 1 | Comparative Example 3 | Comparative Example 4 |
|---|---|---|---|
| Spinning Conditions | | | |
| Polymer | A | B | PEN |
| Persistence Length (Å) | 15 | 13 | 14 |
| Spinning Hole Diameter (mm) | 0.5 | 0.5 | 0.5 |
| Spinning Hole Number | 24 | 24 | 24 |
| Spinning Speed (g/min/hole) | 2.5 | 2.5 | 1.0 |
| Spinning Temperature (°C.) | 260 | 280 | 310 |
| Take-up Speed (m/min) | 4500 | 4500 | 4500 |
| SSF | 424 | 424 | 1060 |
| Physical Properties of Spun Filaments | | | |
| Denier (d) | 121 | 125 | 49 |
| Tenacity (g/d) | 8.7 | 5.3 | 6.9 |
| Elongation at Break (%) | 4.2 | 40.2 | 9.2 |
| Initial Modulus (g/d) | 308 | 75 | 176 |
| 160° C. Hot Air Shrinkage (%) | 0.3 | 4.7 | 2.0 |

TABLE 3

| | Example 3 | Example 4 | Comparative Example 5 | Comparative Example 6 |
|---|---|---|---|---|
| Heat-Treatment Conditions | | | | |
| Temperature (°C.) | 200 | 220 | 200 | 240 |
| Time (min) | 720 | 480 | 720 | 840 |
| Physical Properties of Heat-treated Filaments | | | | |
| Denier (d) | 120 | 119 | 223 | 50 |
| Tenacity (g/d) | 15.7 | 16.1 | 5.3 | 6.7 |
| Elongation at Break (%) | 5.3 | 5.5 | 25.4 | 9.9 |
| Initial Modulus (g/d) | 317 | 321 | 121 | 182 |
| 160° C. Hot Air Shrinkage (%) | 0.3 | 0.2 | 0.5 | 0.3 |

In accordance with the present invention, pseudo-liquid crystal spinning, which has not been effected by any conventional prior art, is carried out in producing polyester fibers having high tenacity and high modulus. Accordingly, the practical and economical problems in the related prior art technique have been solved by the present invention. Specifically, the present invention provides a novel process for industrially stably producing polyester fibers having high tenacity and high modulus and the novel process is free from all the technical problems in the related prior arts.

What we claim is:

1. A method for producing polyester fibers comprising subjecting a copolyester to melt-spinning at a take-up speed of 3000 meter/min. or higher, said copolyester comprising a rigid chain component and 60 mol % or more of ethylene terephthalate units, said copolyester having a persistence length of 15 angstroms or more and not showing liquid crystalline nature in the molten state but being converted to a pseudo-liquid crystalline phase during spinning.

2. A method according to claim 1 wherein the persistence length is 15 to 20 angstroms.

3. A method according to claim 1 wherein the take-up speed is 4000 meters/min. or higher.

4. A method according to claim 1 wherein SSF (take-up speed/polymer jet velocity at orifice) is 250 or more.

5. A method according to claim 4, wherein SSF is 400 or more.

6. A method according to claim 1 wherein the fibers produced have a tenacity of 6 g/d or more and an initial modulus of 300 g/d or more.

7. A method according to claim 6, wherein the fibers obtained by the melt-spinning are subjected to heat-treatment to effect solid phase polymerization, the heat-treated fibers having a tenacity of 15 g/d or more.

* * * * *